United States Patent [19]

Goto

[11] 4,092,096

[45] May 30, 1978

[54] BATTERY OPERATED LIGHTER EQUIPPED WITH A DIGITAL TIMEPIECE

[75] Inventor: Kenjiro Goto, Urawa, Japan

[73] Assignee: Mansei Kogyo Kabushiki Kaisha, Saitama, Japan

[21] Appl. No.: 754,002

[22] Filed: Dec. 27, 1976

[30] Foreign Application Priority Data

Dec. 27, 1975 Japan ..... 50-158059

[51] Int. Cl.[2] ..... F23Q 2/32

[52] U.S. Cl. ..... 431/253; 58/23 BA; 58/53; 58/152 R; 58/88 E

[58] Field of Search ..... 431/255, 253, 125, 132, 431/135; 58/23 BA, 53, 54, 55, 56, 152 R, 88 R, 88 G, 88 E

[56] References Cited

U.S. PATENT DOCUMENTS

| | | | |
|---|---|---|---|
| 2,577,679 | 12/1951 | Fraser | 431/253 |
| 3,811,819 | 5/1974 | Toiseux | 431/255 |
| 3,816,056 | 6/1974 | Brown | 431/253 |
| 4,003,198 | 1/1977 | Morokawa | 58/152 R |

*Primary Examiner*—Edward G. Favors

*Attorney, Agent, or Firm*—Oblon, Fisher, Spivak, McClelland & Maier

[57] ABSTRACT

A battery operated lighter equipped with a digital timepiece including an ignition circuit for generating an electric spark to ignite a lighter fuel, a timepiece circuit being electrically connected to the ignition circuit and adapted to operate a digital time display, a casing for housing therein the ignition circuit and the timepiece circuit, and a circuit for preventing a noise signal caused by operation of the ignition circuit from affecting the timepiece circuit.

11 Claims, 9 Drawing Figures

BATTERY OPERATED LIGHTER EQUIPPED WITH A DIGITAL TIMEPIECE

BACKGROUND OF THE INVENTION

1. Field of the Invention

The present invention relates to a battery operated lighter which is equipped with a digital timepiece, and more particularly to an electric circuit arrangement therefor.

2. Description of the Prior Art

In a battery operated lighter, when an ignition circuit is actuated, this causes a noise signal having a high frequency component in the ignition circuit. If an electric digital timepiece is assembled in the battery lighter, the noise signal affects the timepiece circuit so as to cause the unexpected working thereof. Thus, the digital timepiece often malfunctions in time display due to the operation of the ignition circuit.

In this type of battery lighter, one pole of a battery is arranged in an electrical connection to a casing. Therefore, if an electric spark discharges at the unexpected position other than a spark gap for ignition, for example between an electrode and the casing, a noise signal having a high frequency component such as a surge voltage is applied on the battery voltage thereby causing fluctuation of the source voltage for the timepiece circuit. When the fluctuation is large, the timepiece circuit is affected thereby and works irregularly and causes unexpected operation of the time display. Further, in the normal construction of the battery lighter, a battery is held in resilient contact with a terminal plate. The battery therefore sometimes gets separated instantaneously from the terminal plate, for example, when the lighter drops to the floor. At this time, a power supply for the timepiece circuit becomes nought and the timepiece circuit stops working. Thus, the timepiece is prevented from displaying correct time.

SUMMARY OF THE INVENTION

It is, therefore, an object of the present invention to provide an improved battery lighter equipped with a digital timepiece, which ensures a reliable operation of a timepiece circuit.

Another object of the present invention is to provide an improved electric circuit arrangement for a battery lighter equipped with a digital timepiece, in which a noise signal is restrained from affecting the regular operation of a timepiece circuit.

According to the present invention, there is provided a battery operated lighter equipped with a digital timepiece, comprising an ignition circuit for generating an electric spark to ignite a lighter fuel, a timepiece circuit being electrically connected to the ignition circuit and adapted to operate a digital time display means, a casing for housing therein the ignition circuit and the timepiece circuit, a battery being arranged within the casing to energize each of the circuits, and means for restraining a noise signal of high frequency component, which is caused by operation of the ignition circuit, from affecting the timepiece circuit. The timepiece circuit is provided with a control terminal for controlling time on the display means. The noise restraining means is electrically connected between the battery and the control terminal in order to extinguish the noise signal which enters from the control terminal. Further, in order to restrain the influence of a noise signal, especially of a surge voltage, which results from sparking anywhere other than at a spark gap, upon the timepiece circuit, it is preferable to connect a capacitor in parallel to the battery. The capacitor is also connected to each source terminal the timepiece circuit. Even if the battery gets separated instantaneously from the circuit connection, the timepiece circuit may continue the regular working by the power supplied from the capacitor. It is also preferrable to connect the negative pole of the battery to the casing in order to bring the level of surge voltage downs, when the surge voltage occurs.

BRIEF DESCRIPTION OF THE DRAWINGS

Other features and advantages of the invention will be apparent from the following description taken in connection with the accompanying drawing, wherein.

DESCRIPTION OF THE PREFERRED EMBODIMENTS

Figure 1:
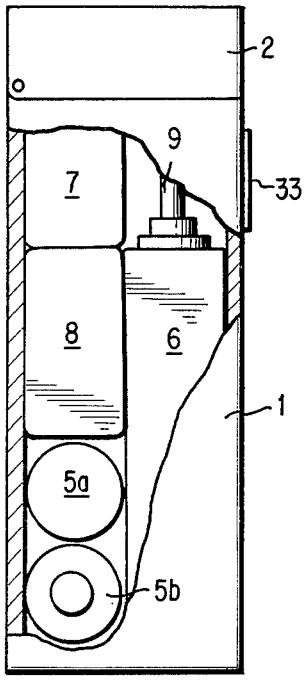
FIG. 1 is an elevation, in partial section, of a preferred embodiment according to the present invention.
Figure 2:
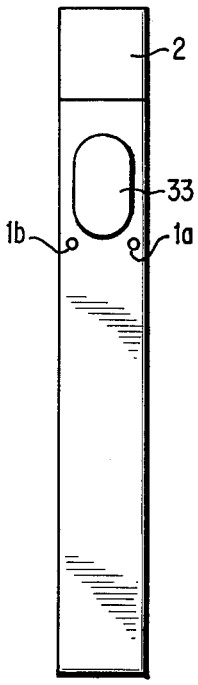
FIG. 2 is a side elevation thereof.
Figure 3:
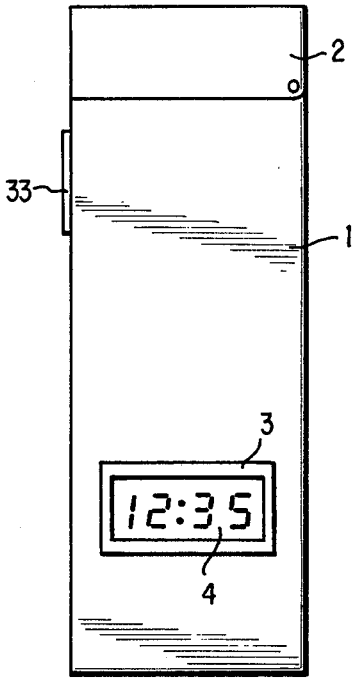
FIG. 3 is a rear elevation thereof.

The lighter shown and in attitude depicted includes a casing 1 of electrically conductive material on which a pivotal cap 2 is mounted. At the lateral side of casing 1 there is arranged a display window 3 on which is arranged a conventional time display device 4 using a light emitting diode (hereinafter, preferred to as LED display device). Casing 1 houses two batteries **5*a* and 5*b*, a fuel reservoir 6, an ignition circuit 7 and a timepiece circuit 8. A thumb piece 33 is reciprocally arranged on the lateral side of casing 1 to control ignition circuit 7 and timepiece circuit 8. Reservoir 6 is provided with a burner valve 9 which is slidable up and down. Ignition circuit 7 generates an electric spark for igniting a fuel gas issued out of burner valve 9**.

Figure 4:
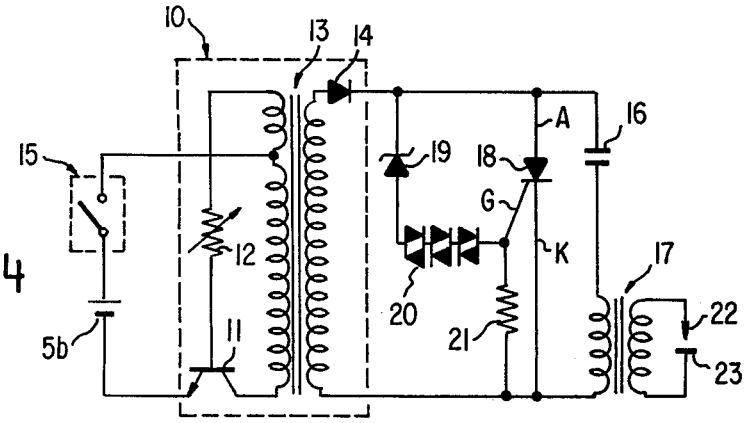
FIG. 4 is a diagram showing one form of an ignition circuit.

As seen in FIG. 4, ignition circuit 7 has a converter 10 which consists of a transistor 11, variable resistor 12, oscillation transformer 13 and diode 14. Converter 10 is connected through an ignition switch 15 to battery **5*b* and also in series connected at its output side to an electric charge storage capacitor 16 and a step-up transformer 17. A semiconductor swiching element 18 (hereinafter, referred to as SCR) is in parallel connected to capacitor 16 and step-up transformer 17. A triggering element consists of a zener diode 19 and series diac 20, and is connected between an anode A and gate G of SCR 18. A resistor 21 for protecting the gate G of SCR 18 is connected between the gate G and cathode K of SCR 18. Step-up transformer 17 is connected on its secondary side to a pair of electrodes 22 and 23 each of which is positioned adjacent to said burner valve 9** to form a spark gap.

Figure 5:
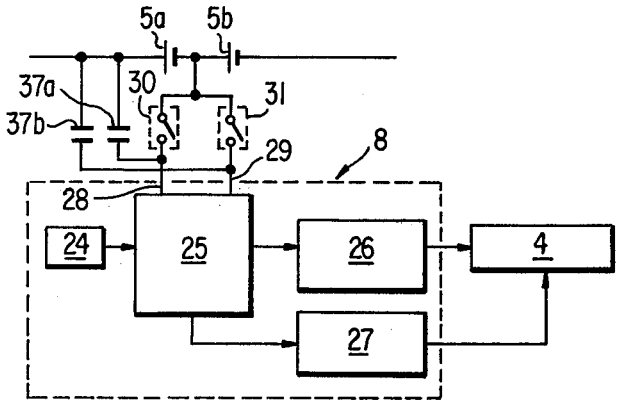
FIG. 5 is a schematic diagram showing one form of a timepiece circuit.

Referring to FIG. 5, there is shown the timepiece circuit 8 for operating LED display device 4. Two batteries **5*a* and 5*b* are in series connected to each other and used for a power source of timepiece circuit 8. The timepiece circuit comprises a crystal oscillator 24, control circuit 25, segment driver 26 and digit driver 27. Control circuit 25 functions dividing the output frequency from crystal oscillator 24, counting the divided frequency and decoding selectively the counted frequency. Segment driver 26 and digit driver 27 amplify a segment signal and digit signal from control circuit 25 and put these signals into LED display device 4. A display terminal 28 for controlling the time display of LED display device 4, and a time adjusting terminal 29 for controlling the time adjustment of LED display device 4, both extend from control circuit 25. A display control switch 30 is connected between display terminal 28 and the negative pole of battery 5***a*. And a time adjusting switch 31 is connected between adjusting terminal 29 and the negative pole of battery 5*a*.

Figure 6:
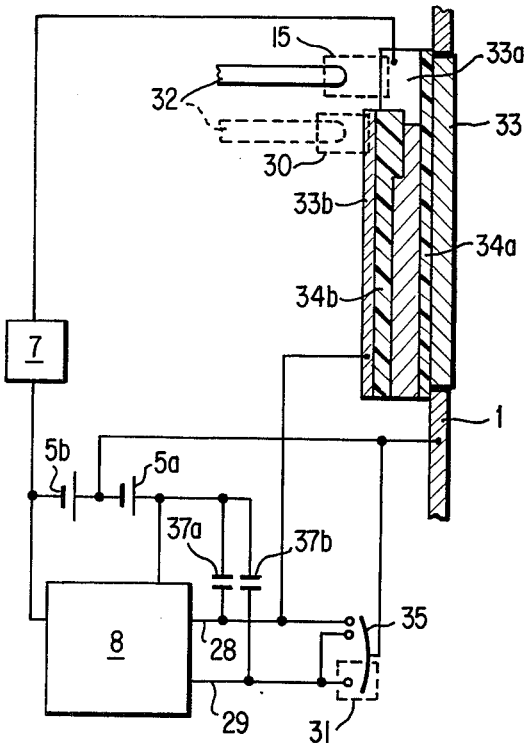
FIG. 6 is an explanatory diagram showing the relationship between the ignition circuit and the timepiece circuit.

In FIG. 6, thumb piece 33 has a first and second electrically conductive members 33*a* and 33*b*. In the face of these conductive members 33*a* and 33*b*, there is arranged a valve control plate 32 which is movable up and down to actuate burner valve 9, in accordance with the pivotal movement of cap 2. Control plate 32 is electrically connected to casing 1 and serves as one of switching elements. Control plate 32 may be contacted at its upward position, shown in a solid line, with first conductive member 33*a* and at its downward position, shown in a broken line, with second conductive member 33*b*, wherein the upward position of the plate corresponds to the open state of cap 2 and the downward position corresponds to the closed state of cap 2. First conductive member 33*a* is electrically insulated from casing 1 by an insulation member 34*a*, and second conductive member 33*b* is insulated from the first conductive member and the casing by an insulation member 34*b*. Ignition switch 15 shown in FIG. 4 is thus constituted with control plate 32 and first conductive member 33*a* of thumb piece 33. First conductive member 33*a* is electrically connected through ignition circuit 7 to the negative pole of battery 5*b*, and control plate 32 is electrically connected through casing 1 to the positive pole of battery 5*b*. Accordingly, when first conductive member 33*a* comes into contact with control plate 32, there is formed a closed loop with the positive pole of battery 5*b*, casing 1, control plate 32, first conductive member 33*a*, ignition circuit 7 and the negative pole of battery 5*b*, so as to generate an electric spark between electrodes 22 and 23.

On the other hand, display control switch 30 is constituted with control plate 32 and second conductive member 33*b*. Control plate 32 is electrically connected through casing 1 to the negative pole of battery 5*a*. Second conductive member 33*b* is electrically connected through timepiece circuit 8 to the positive pole of battery 5*a*. Accordingly, when second conductive member 33*b* comes into contact with control plate 32, there is formed a closed loop with the positive pole of battery 5*a*, timepiece circuit 8, second conductive member 33*b*, control plate 32, casing 1 and the negative pole of battery 5*a*, so as to display time on LED display device 4. If necessary to adjust time on LED display device 4, when only time adjusting switch 31 is brought into the closed state, hours displayed on LED dispaly device 4 may advance quickly. When time adjusting switch 31 and display switch 30 are both brought into closed states, minutes displayed on LED display device 4 may advance quickly.

Figure 7:
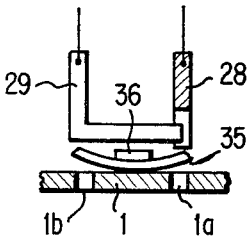
FIG. 7 is a partial view showing one form of a time control switch mechanism.

In FIG. 7, there is shown an example of a time control switch mechanism, wherein a curved spring member 35 is arranged inside of casing 1 and adjacent to thumb piece 33. Spring member 35 is electrically connected to the negative pole of battery 5*a*. At the middle of spring member 35 is arranged an insulation member 36 which serves as a fulcrum for transforming spring member 35. Display terminal 28 is positioned adjacent to an end of spring member 35 to be contacted. Time adjusting terminal 29 of L-shape is positioned facing spring member 35 through insulation member 36 so as possible to contact each end of spring member 35. Casing 1 is provided with a first and second hole 1*a* and 1*b* through which each end of spring member 35 may be pushed inwards by an appropriate means such as a pin. If necessary to adjust the time to a correct time, the left end of spring member 35 is pushed through second hole 1*b*. Spring member 35 comes in contact with adjusting terminal 29 to turn on time adjusting switch 31, thereby resulting in quick advance of hours. Then, pushing the right end of spring member 35 through first hole 1*a*, the member comes in contact with display terminal 28 and time adjusting terminal 29 in turns. Display control switch 30 and adjusting switch 31 thus turn on to quickly advance minutes.

Figure 8:
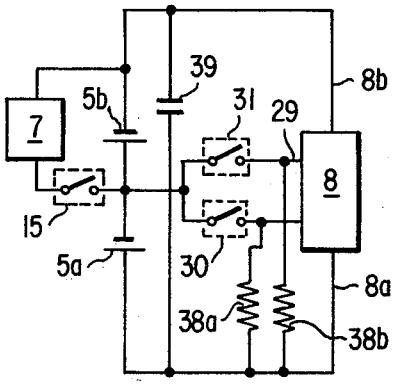
FIGS. 8 and 9 are partially modified schematic diagrams, each showing an arrangement of noise restraining means.

The relationship between ignition circuit 7 and timepiece circuit 8 will be explained hereunder. When ignition circuit 7 is operated, this causes a high frequency wave, for example, at the secondary sides of oscillation transformer 13 and step-up transformer 17, and otherwise at the spark gap. This high frequency wave turns into a noise signal to affect timepiece circuit 8. That is to say, even if display control switch 30 and time adjusting switch 31 are in OFF state, the noise signal is coupled to display terminal 28 and/or time adjusting terminal 29 so as to cause the unexpected time display and/or the unexpected quick advance of time on LED display device 4. In order to restrain the noise signal from affecting timepiece circuit 8, capacitors 37*a* and 37*b* are arranged respectively between the positive pole of battery 5*a* and display terminal 28, and between the positive pole of battery 5*a* and adjusting terminal 29. Alternatively, it is effective for restraining the noise signal to connect capacitors 37*a* and 37*b* between the negative pole of battery 5*b* and each of display terminal 28 and adjusting terminal 29. As seen in FIG. 8, resistors 38*a* and 38*b* are substituted for capacitors 37*a* and 37*b*. Not shown in the drawings are other noise restraining methods as using sealed wires for display terminal 28 and adjusting terminal 29 and covering ignition circuit 7 with an aluminum foil.

Figure 9:
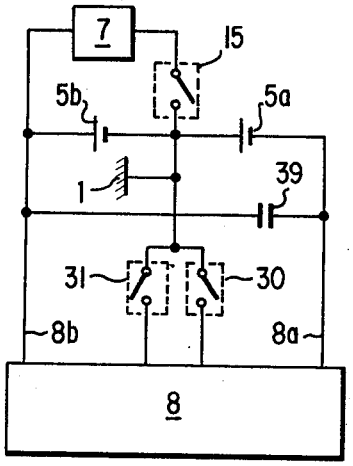

Further, when an electric spark due to the operation of ignition circuit 7 occurs anywhere other than between electrodes 22 and 23, for example between electrode 22 and casing 1, a noise signal having a high frequency component such as a surge voltage (hereinafter, referred to as surge voltage) is caused and applied through casing 1 on battery 5*b*, thereby resulting in a fluctuation of the source voltage for timepiece circuit 8. The timepiece circuit malfunctions under the influence of the surge voltage and causes the unexpected time display and/or the unexpected quick advance of time on LED display device 4. As seen in FIGS. 8 and 9, in order to prevent the wrong operation of timepiece circuit 8 under the surge voltage, a capacitor 39 is parallel connected to batteries 5*a* and 5*b*, and extends between source terminals 8*a* and 8*b* of timepiece circuit 8. Alternatively, it is possible for obtaining the same result to connect capacitor 39 in parallel to only one battery 5*b*. Capacitor 39 functions to absorb the surge voltage and lessen the fluctuation of the source voltage for timepiece circuit 8. The circuit may work regularly without being affected by the surge voltage. Connecting capacitor 39 in parallel to batteries 5*a* and 5*b* is also advantageous when the batteries get separated instantaneously from their electrical connection, because capacitor 39 may supply the electric charge to timepiece circuit 8, instead of batteries 5*a* and 5*b*. The timepiece circuit can continue regular working. As seen in FIG. 9, it is also useful to electrically connect the negative pole of battery 5*b* to casing 1 in order to lessen the effect of the surge voltage. According to this connection, it is possible to bring the level of the surge voltage down and to limit the source voltage within such a range as not to affect timepiece circuit 8. Apparently, the best way for restraining the effect of surge voltage is not only connect capacitor 39 in parallel to one or two of batteries 5*a* and 5*b* but also to electrically ground the negative pole of battery 5*b*, serving as a power source of ignition circuit 7, to casing 1.

In operation, when rotating pivotal cap 2 upwards, control plate 32 moves upwards and burner valve 9 also moves upwards to issue fuel gas therefrom. Then, pushing thumb piece 33 inwardly of casing 1, first conductive member 33*a* of thumb piece 33 contacts control plate 32 so that ignition circuit 7 operates to generates an electric spark at the spark gap. The spark thus generated ignites the fuel gas issuing out of burner valve 9. When cap 2 is closed, control plate 32 moves downwards to stop issuing the fuel gas from burner valve 9. At the same time, first conductive member 33*a* is released from the contact with control plate 32 to stop the operation of ignition circuit 7. When pushing thumb piece 33 inwardly of casing 1 as the cap is in the closed state, second conductive member 33*b* contacts control plate 32 to turn on dispaly control switch 30. Timepiece circuit 8 functions to have time displayed on LED display device 4.

In this embodiment, reference as to a display means is made to the LED display device but it is possible to use a liquid crystal display device, instead. It will be also understood that a single battery may be used as a power source for each ignition circuit 7 timepiece circuit 8 although two batteries 5*a* and 5*b* are used in the embodiment. In this case, arrangement of capacitors 37*a*, 37*b* and 39 may be achieved in the same way as described before. It is further to be understood that various changes in the circuits and arrangement of elements may be resorted to without departing from the spirit of the invention or the scope of the subjoined claims.

What is claimed as new and desired to be secured by Letters Patent of the United States is:

1. A battery operated lighter equipped with a digital timepiece comprising:

a casing;

digital time display means in the casing;

ignition circuit means housed in the casing for generating an electric spark to ignite a lighter fuel;

timepiece circuit means housed in the casing and electrically connected to the ignition circuit means for operating the digital time display means;

a battery arranged within the casing to energize the ignition circuit means and the timepiece circuit means;

means for preventing a noise signal having a high frequency component and caused by the operation of the ignition circuit means from affecting the timepiece circuit means.

2. A lighter as set forth in claim 1 wherein the timepiece circuit means is provided with a control terminal; and the noise preventing means is electrically connected between the battery and the control terminal.

3. A lighter as set forth in claim 2 wherein the control terminal comprises a time adjusting terminal and the noise preventing means comprises a capacitor connected between the battery and the adjusting terminal.

4. A lighter as set forth in claim 2 wherein the control terminal comprises a time adjusting terminal; and the noise preventing means comprises a resistor connected between the battery and the adjusting terminal.

5. A lighter as set forth in claim 1 wherein the timepiece circuit means is provided with a time adjusting terminal and a display terminal; and the noise preventing means comprises two capacitors respectively connected between the battery and each of the terminals.

6. A lighter as set forth in claim 1 wherein the timepiece circuit means is provided with a time adjusting terminal and a display terminal; and the noise preventing means comprises two resistors respectively connected between the battery and each of the terminals.

7. A lighter as set forth in claim 2 including a spring member connected to the battery and arranged adjacent to the control terminal for operating the control terminal; and wherein the casing has a hole through which the spring member is operated to contact the control terminal at its respective ends.

8. A lighter as set forth in claim 1 including a capacitor connected in parallel to the battery.

9. A lighter as set forth in claim 1 including a first battery for energizing the ignition circuit means; a second battery connected in series with the first battery for energizing the timepiece circuit means; and a capacitor connected in shunt with the series combination of the first and second batteries, and also across the timepiece circuit means.

10. A lighter as set forth in claim 8, wherein the battery is electrically grounded at its negative side to the casing.

11. A lighter as set forth in claim 9, wherein the first battery is electrically grounded at its negative side to the casing.

* * * * *